US006326331B1

(12) United States Patent
Horsten et al.

(10) Patent No.: US 6,326,331 B1
(45) Date of Patent: Dec. 4, 2001

(54) SUBSTANTIALLY LIGHT-INSENSITIVE BLACK AND WHITE THERMOGRAPHIC RECORDING MATERIAL WITH IMPROVED STABILITY TO DIRECT SUNLIGHT

(75) Inventors: Bartholomeus Cyriel Horsten, Rumst; Guy Denis Jansen, Borsbeek, both of (BE)

(73) Assignee: Agfa-Gevaert (BE)

( * ) Notice: Subject to any disclaimer, the term of this patent is extended or adjusted under 35 U.S.C. 154(b) by 0 days.

(21) Appl. No.: 09/452,000

(22) Filed: Nov. 30, 1999

Related U.S. Application Data

(60) Provisional application No. 60/118,490, filed on Feb. 3, 1999.

(30) Foreign Application Priority Data

Nov. 30, 1998 (EP) ..... 98204014

(51) Int. Cl.[7] ..... B41M 5/28

(52) U.S. Cl. ..... 503/201; 503/202; 503/209; 503/212

(58) Field of Search ..... 503/202, 209, 503/212, 201

(56) References Cited

FOREIGN PATENT DOCUMENTS

| | | |
|---|---|---|
| 784615 | 10/1972 | (BE) . |
| 0713133 | 5/1996 | (EP) . |
| 0809142 | 11/1997 | (EP) . |

*Primary Examiner*—Bruce H. Hess
(74) *Attorney, Agent, or Firm*—Leydig, Voit & Mayer, Ltd.

(57) ABSTRACT

A substantially light-insensitive black and white non-chlorine-containing stabilizer-containing monosheet thermographic recording material comprising a support and a thermosensitive element, the thermosensitive element containing a substantially light-insensitive organic silver salt, a reducing agent therefor in thermal working relationship therewith and a binder, characterized in that the non-chlorine-containing stabilizer is selected from the group consisting of 2-(2'-hydroxyphenyl)benzotriazole derivatives and 2-hydroxy-benzophenone derivatives; a thermographic recording process therefor; and the use thereof as a stabilizer against direct sunlight.

18 Claims, No Drawings

SUBSTANTIALLY LIGHT-INSENSITIVE BLACK AND WHITE THERMOGRAPHIC RECORDING MATERIAL WITH IMPROVED STABILITY TO DIRECT SUNLIGHT

The application claims the benefit of the U.S. Provisional application No. 60/118,490 filed Feb. 3, 1999.

FIELD OF THE INVENTION

The present invention relates to substantially light-insensitive black and white mainsheet thermographic recording materials with improved stability to direct sunlight.

BACKGROUND OF THE INVENTION

Thermal imaging or thermography is a recording process wherein images are generated by the use of thermal energy. In direct thermal thermography a visible image pattern is formed by image-wise heating of a recording material containing matter that by chemical or physical process changes colour or optical density. Most of the "direct" thermographic recording materials are of the chemical type. On heating to a certain conversion temperature, an irreversible chemical reaction takes place and a coloured image is produced.

BE-A 784,615 discloses a photographic material comprising a paper support, characterized in that the support is coated with a layer having a Sheffield smoothness between 5 and ca. 100, the layer containing a first binder of the type polysaccharide, a pigment, a second binder, a photosensitive compound, including 2,4-dihydroxy-benzophenone, and an oxidation-reduction imaging forming system.

EP-A 713 133 discloses a two sheet thermal imaging system consisting of (i) a donor element comprising on a support a donor layer containing a binder and a thermotransferable reducing agent capable of reducing a silver source to metallic silver and (ii) a receiving element comprising on a support a receiving layer comprising a silver source, capable of being reduced by means of heat in the presence of a reducing agent, a binder and a stabiliser selected from the group consisting of benzotriazoles, heterocyclic mercaptanes, sulphinic acids, 1,3,4-triazo-indinolines, 1,3-dinitroaryl compounds, 1,2,3-triazoles, phthalic acids and phthalic acid derivatives.

EP-A 809 142 discloses a recording material comprising a support, a thermosensitive element and a protective layer therefor, the thermosensitive element comprising a substantially light-insensitive organic silver salt, an organic reducing agent therefor in thermal working relationship therewith and a binder, wherein the thermosensitive element further comprises in reactive association with the substantially light-insensitive organic silver salt and the organic reducing agent a substituted, exclusive of groups having an exclusively electron withdrawing character, or unsubstituted compound with an unsaturated 5-membered heterocyclic ring annulated with an aromatic ring system, the ring consisting of nitrogen and carbon atoms with at least one of the nitrogen atoms having a hydrogen atom and none of the carbon atoms being directly linked to a sulfur atom or being part of a carbonyl-group.

Substantially light-insensitive black and white two sheet thermographic recording materials according to EP 713 133 produce an image in the receiving sheet with imagewise transferred reducing agent and hence totally different stability requirements to monosheet materials. Substantially light-insensitive black and white monosheet thermographic recording materials including non-N-substituted benzotriazoles according to the teaching of EP-A 809 142 exhibit poor stability to direct sunlight.

OBJECTS OF THE INVENTION

It is therefore an object of the present invention to provide a substantially light-insensitive black and white monosheet thermographic recording material based on organic silver salts and reducing agents with improved stability to direct sunlight and capable of producing an image with an acceptably neutral image tone.

Further objects and advantages of the invention will become apparent from the description hereinafter.

SUMMARY OF THE INVENTION

Surprisingly it has been found that incorporating non-chlorine-containing 2-(2'-hydroxyphenyl)benzotriazole derivatives and 2-hydroxy-benzophenone derivatives into substantially light-insensitive black and white monosheet thermographic recording materials based on organic silver salts and reducing agents results in materials whose prints exhibit improved stability to direct sunlight and an acceptably neutral image tone.

The above-mentioned objects are realized by a substantially light-insensitive black and white non-chlorine-containing stabilizer-containing monosheet thermographic recording material comprising a support and a thermosensitive element, said thermosensitive containing a substantially light-insensitive organic silver salt, a reducing agent therefor in thermal working relationship therewith and a binder, wherein the non-chlorine-containing stabilizer is selected from the group consisting of 2-(2'-hydroxyphenyl)-benzotriazole derivatives and 2-hydroxy-benzophenone derivatives.

A recording process is further provided according to the present invention comprising the steps of: (i) bringing an outermost layer of the above-mentioned thermographic recording material into proximity with a heat source; and (ii) applying heat from the heat source imagewise to the recording material while maintaining proximity to the heat source to produce an image; and (iii) removing the recording material from the heat source.

Use of a non-chlorine-containing stabilizer selected from the group consisting of 2-(2'-hydroxyphenyl)-benzotriazole derivatives and 2-hydroxy-benzophenone derivatives as a stabilizer against direct sunlight in a substantially light-insensitive black and white monosheet thermographic recording material comprising a support and a thermosensitive element, the thermosensitive element containing a substantially light-insensitive organic silver salt, a reducing agent therefor in thermal working relationship therewith and a binder, is also provided by the present invention.

Preferred embodiments of the invention are disclosed in the dependent claims.

DETAILED DESCRIPTION OF THE INVENTION

In a preferred embodiment of the recording process, according to the present invention, the heat source is a thermal head with a thin film thermal head being particularly preferred.

DEFINITIONS

By substantially light-insensitive is meant not intentionally light sensitive.

By a non-chlorine-containing compound is meant a compound with no chlorine atoms in its structure.

By a polymer having active hydrogen atoms is meant a polymer having substituents with hydrogen atoms which readily react such as hydroxy groups, thiol groups, carboxy groups, -N-H groups, amino groups, amido groups etc.

By polyisocyanate is meant a compound having at least two isocyanate groups which may or no be blocked with groups which are readily displaced during a hardening process.

2-(2'-hydroxyphenyl)benzotriazole derivatives and 2-hydroxy-benzophenone derivatives Preferred non-chlorine-containing 2-(2'-hydroxyphenyl)-benzotriazole derivatives have substituents on the benzene ring of the benzotriazole and/or the phenyl group for example alkyl groups, such as methyl, t-butyl, t-amyl, t-octyl etc., aryl, alkaryl, aralkyl, such as benzyl, α,α-dimethylbenzyl etc., alkoxy, alkcarboxylate groups etc. These groups may be further substituted with hydroxy, alkyl, alkaryl, aralkyl, aryl, alkoxy, alkcarboxylato, 2-benzotriazolo groups etc. Suitable non-chlorine-containing 2-(2'-hydroxyphenyl)-benzotriazole derivatives for use in the substantially light-insensitive black and white stabilizer-containing monosheet thermographic recording material of the present invention, while not adversely changing the neutrality of the image tone of the image background, are:

STAB 01: 2-(2'-hydroxy-5-methylphenyl)benzotriazole, TINUVIN™ P from CIBA-GEIGY;

STAB 02: 2-(2'-hydroxy-5'-t-octylphenyl)benzotriazole, CYASORB™ UV 5411 from American Cyanamid Co.;

STAB 03: 2-[2'-hydroxy-3',5'-(di-t-butyl)phenyl] benzotriazole, TINUVIN™ 320 from CIBA-GEIGY:

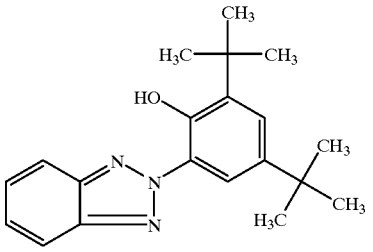

STAB 04: 2-[2'-hydroxy-3',5'-(di-t-amyl)phenyl] benzotriazole, TINUVIN™ 328 from CIBA-GEIGY:

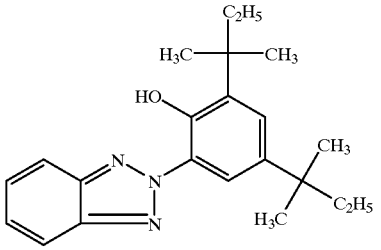

STAB 05: 2-[2'-hydroxy-3',5'-di-(α,α-dimethylbenzyl) phenyl]-benzotriazole, TINUVIN™ 900 from CIBA-GEIGY:

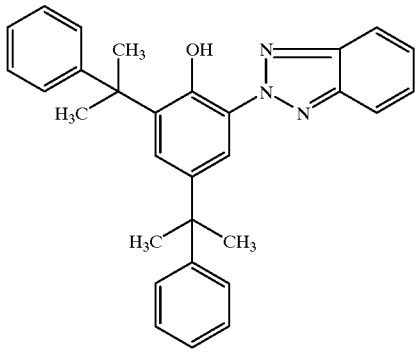

STAB 06: 2-[2'-hydroxy-5-(1",1",3",3"-tetramethylbutyl)-phenyl]-benzotriazole;

STAB 07: 2,2-methylene-bis-[5-(2H-benzotriazol-1-yl)-3-(1",1",3",3"-tetramethylbutyl)-phenol]:

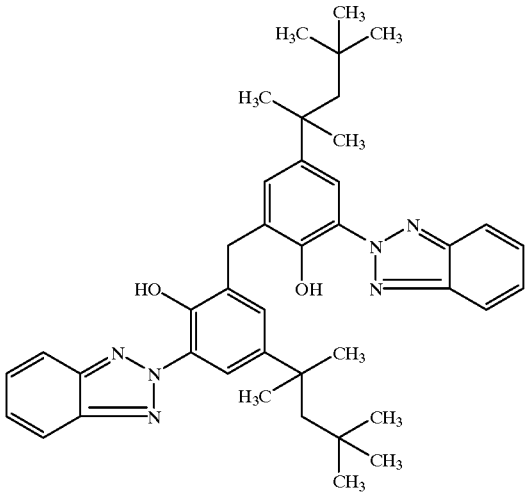

STAB 08: 2-{3'-t-butyl-2'-hydroxy-5'-[2-ethyl-(methylpoly-ethyleneoxide)-ketono]-phenyl}-benzotriazole.

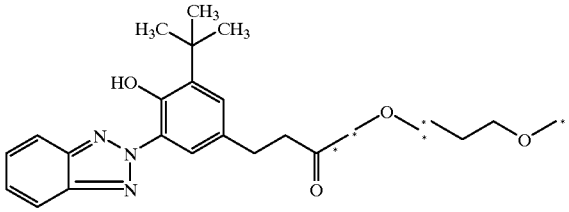

STAB 09: TINUVIN™ 213 from CIBA-GEIGY:

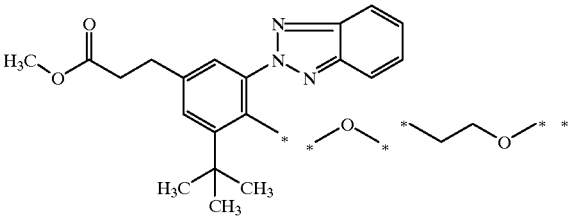

STAB 10: 2-{3'-t-butyl-2'-hydroxy-5-3-(octylpropionato)-phenyl}-benzotriazole, TINUVIN™ 384 from CIBA-GEIGY:

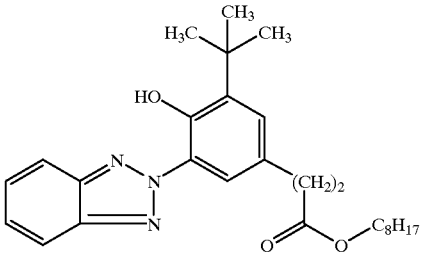

STAB 11:

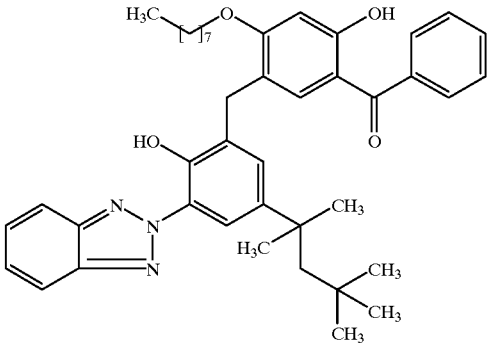

Preferred non-chlorine-containing 2-hydroxy-benzophenone derivatives have substituents on the benzene ring of one or both of the benzene rings for example alkyl, aryl, alkaryl, aralkyl, hydroxy, alkoxy, alkcarboxylato groups etc. Suitable non-chlorine-containing 2-hydroxy-benzophenone derivatives for use in the substantially light-insensitive black and white stabilizer-containing monosheet thermographic recording material of the present invention, while not adversely changing the neutrality of the image tone of the image background, are:

STAB 12: 2,4-dihydroxybenzophenone;

STAB 13: 2-hydroxy-4-methoxybenzophenone;

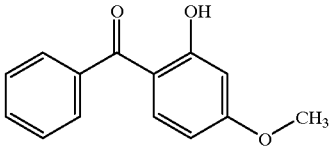

STAB 14: 2-hydroxy-4-n-octyloxybenzophenone;

STAB 15: 2-hydroxy-4-isooctyloxybenzophenone;

STAB 16: 2-hydroxy-4-dodecyloxybenzophenone;

STAB 17: 2,2'-dihydroxy-4-methoxybenzophenone;

STAB 18: 2,2',4,4'-tetrahydroxybenzophenone;

STAB 19: 2,2'-dihydroxy-4,4'-dimethoxybenzophenone.

In a preferred embodiment of the present invention the thermographic recording material, the non-chlorine-containing 2-(2'-hydroxyphenyl)benzotriazole derivative contains a 2-hydroxy-benzophenone group. In another preferred embodiment of the present invention, the non-chlorine-containing 2-(2'-hydroxyphenyl)-benzotriazole derivative used according to the present invention is selected from the group consisting of 2-[2'-hydroxy-3',5'-(di-t-butyl) phenyl]-benzotriazole, 2-[2'-hydroxy-3',5'-di-(α,α-dimethylbenzyl)phenyl]-benzotriazole, 2,2-methylene-bis-[5- (2H-benzotriazol-1-yl)-3-(1",1",3",3"-tetramethylbutyl)-phenol],2,2-methylene-bis-[5-(2H-benzotriazol-1-yl)-3-(1", 1",3",3"-tetramethylbutyl)-phenol],

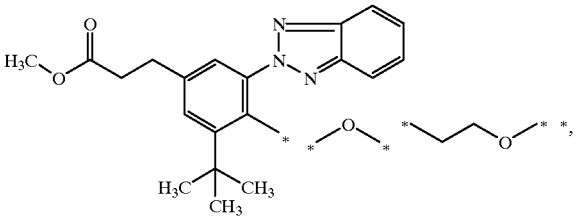

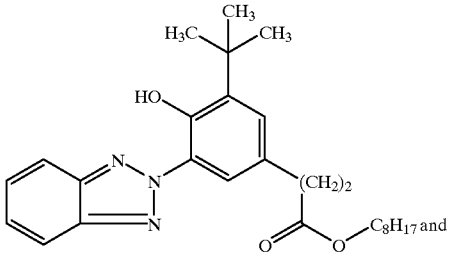

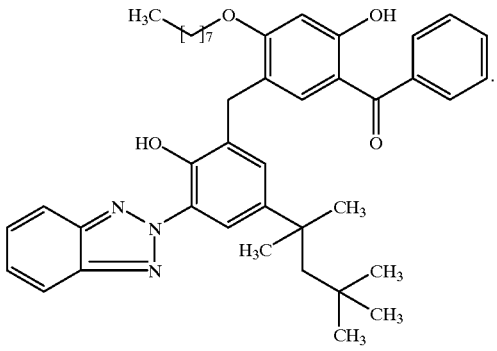

Mixtures of one or more 2-(2'-hydroxyphenyl) benzotriazole derivatives; one or more 2-hydroxy-benzophenone derivatives; or one or more 2-(2'-hydroxyphenyl)benzotriazole derivatives with one or more 2-hydroxy-benzophenone derivatives can be used in the thermographic recording material of the present invention.

Thermosensitive Element

The thermosensitive element, according to the present invention, contains a substantially light-insensitive organic silver salt, a reducing agent therefor in thermal working relationship therewith and a binder. The element may comprise a layer system in which the ingredients may be dispersed in different layers, with the proviso that the substantially light-insensitive organic silver salt is in reactive association with the reducing agent i.e. during the thermal development process the reducing agent must be present in such a way that it is able to diffuse to the particle of substantially light-insensitive organic silver salt so that reduction to silver can occur. In a preferred embodiment the thermosensitive element further contains a polymer having active hydrogen atoms at least part of which has reacted with a polyisocyanate.

Organic Silver Salts

Preferred substantially light-insensitive organic silver salts for use in the thermosensitive element of the substantially light-insensitive black and white thermographic recording material used in the present invention, are silver salts of aliphatic carboxylic acids known as fatty acids, wherein the aliphatic carbon chain has preferably at least 12 C-atoms, which silver salts are also called "silver soaps". Combinations of different organic silver salts may also be used in the imaging materials of the present invention.

Reducing Agents

Suitable organic reducing agents for the reduction of the substantially light-insensitive organic silver salts are organic compounds containing at least one active hydrogen atom linked to O, N or C, such as is the case with: catechol; hydroquinone; aminophenols; METOL™; p-phenylenediamines; alkoxynaphthols, e.g. 4-methoxy-1-naphthol described in U.S. Pat. No. 3,094,417; pyrolidin-3-one type reducing agents, e.g. PHENIDONE™; pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. Nos. 3,074,809, 3,080,254, 3,094,417 and 3,887,378.

The choice of reducing agent influences the thermal sensitivity of the imaging material and the gradation of the image. Imaging materials using gallates, for example, have a high gradation. In a preferred embodiment of the present invention the thermographic element contains a 3,4-dihydroxyphenyl compound with ethyl 3,4-dihydroxybenzoate, butyl 3,4-dihydroxybenzoate and 3,4-dihydroxy-benzoic acid and compounds represented by formula (I):

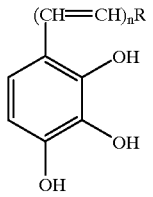

where n is 0 or 1; R is —(C═O)$R^1$, —(C═O)$NR^1R^2$, —CN, —$SO_3R^1$, —$SO_2R^1$, —$SOR^1$, —$SO_2NR^1R^2$ or —$PO_3R^1R^2$; $R^1$ is H or an alkyl, a substituted alkyl, an aryl or a substituted aryl group; and $R^2$ is H or an alkyl, a substituted alkyl, an aryl or a substituted aryl group; and $R^1$ and $R^2$ together can represent the atoms to close a ring, which can be a carbocyclic ring with all the ring atoms being carbon or a heterocyclic ring with the ring atoms being carbon and at least one non-carbon atom e.g. nitrogen, sulfur, oxygen, phosphorus etc. The alkyl and aryl groups can also be substituted with one or more groups selected from hydroxy, cyano, thiol and halogen. Particularly preferred —$(CH{=}CH)_nR$ groups are formyl, oxo-alkyl, oxo-aryl, cyano, carbamido, diphenoxyphosphoryl, alkylsulfinyl, alkylsulfonyl and sulfonylamino groups.

Combinations of reducing agents may also be used that on heating become reactive partners in the reduction of the substantially light-insensitive organic silver salt.

Toning Agents

In order to obtain a neutral black image tone in the higher densities and neutral grey in the lower densities, the thermosensitive element preferably further contains a so-called toning agent known from thermography or photothermography.

Suitable toning agents are the phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Other particularly useful toning agents are the heterocyclic toner compounds of the benzoxazine dione or naphthoxazine dione type as disclosed in GB-P 1,439,478, U.S. Pat. No. 3,951,660 and U.S. Pat. No. 5,599,647.

Binder

The film-forming binder of the thermosensitive element containing mixed crystals of two or more organic silver salts may be all kinds of natural, modified natural or synthetic resins or mixtures of such resins, in which the organic silver salts can be dispersed homogeneously either in aqueous or solvent media: e.g. cellulose derivatives such as ethylcellulose, cellulose esters, e.g. cellulose nitrate, carboxymethylcellulose, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof.

Suitable water-soluble film-forming binders for use in thermographic recording materials according to the present invention are: polyvinyl alcohol, polyacrylamide, polymethacrylamide, polyacrylic acid, polymethacrylic acid, polyvinylpyrrolidone, polyethyleneglycol, proteinaceous binders such as gelatin, modified gelatins such as phthaloyl gelatin, polysaccharides, such as starch, gum arabic and dextran and water-soluble cellulose derivatives. A preferred water-soluble binder for use in the thermographic recording materials of the present invention is gelatin.

Preferred water-dispersible binders for use according to the present invention are water-dispersible film-forming polymers with covalently bonded ionic groups selected from the group consisting of sulfonate, sulfinate, carboxylate, phosphate, quaternary ammonium, tertiary sulfonium and quaternary phosphonium groups. Further preferred water-dispersible binders for use according to the present invention are water-dispersible film-forming polymers with covalently bonded moieties with one or more acid groups. Water-dispersible binders with crosslinkable groups, e.g. epoxy groups, aceto-acetoxy groups and crosslinkable double bonds are also preferred. Particularly preferred water-dispersible binders for use in the thermographic recording materials of the present invention are polymer latexes.

The binder to organic silver salt weight ratio is preferably in the range of 0.2 to 6, and the thickness of the thermosensitive element is preferably in the range of 5 to 50 $\mu$m.

Further Stabilizers and Antifoggants

In order to obtain improved shelf-life and reduced fogging, further stabilizers and antifoggants may be incorporated into the substantially light-insensitive black and white thermographic recording material used in the present invention. Suitable stabilizers compounds for use in the present invention are unsaturated carbocyclic or heterocyclic compounds substituted with a —SA group where A is hydrogen, a counterion to compensate the negative charge of the thiolate group or a group forming a symmetrical or an asymmetrical disulfide.

Surfactants and Dispersants

Surfactants and dispersants aid the dispersion of ingredients which are insoluble in the particular dispersion medium. The substantially light-insensitive black and white thermographic recording material used in the present invention may contain one or more surfactants, which may be anionic, non-ionic or cationic surfactants and/or one or more dispersants.

Suitable dispersants are natural polymeric substances, synthetic polymeric substances and finely divided powders, for example finely divided non-metallic inorganic powders such as silica.

Other Ingredients

In addition to the ingredients the substantially light-insensitive black and white thermographic recording material may contain other additives such as free fatty acids, antistatic agents, e.g. non-ionic antistatic agents including a fluorocarbon group as e.g. in $F_3C\ (CF_2)_6CONH\ (CH_2CH_2O)$—H, silicone oil and silica.

Support

The support of the substantially light-insensitive black and white thermographic recording material used in the present invention may be transparent or translucent and is preferably a thin flexible carrier made transparent resin film, e.g. made of a cellulose ester, e.g. cellulose triacetate, polypropylene, polycarbonate or polyester, e.g. polyethylene terephthalate. The support may be in sheet, ribbon or web form and subbed if needs be to improve the adherence to the thereon coated thermosensitive element. The support may be dyed or pigmented to provide a transparent coloured background for the image.

Protective Layer

The protective layer protects the thermosensitive element from atmospheric humidity and from surface damage by scratching etc. and prevents direct contact of printheads or heat sources with the recording layers. It comes into contact with and has to be transported past a heat source under pressure, has to exhibit resistance to local deformation and has to possess good slipping characteristics during transport past the heat source during heating.

Solid or liquid lubricants or combinations thereof are suitable for improving the slip characteristics of the thermographic recording materials according to the present invention. Solid lubricants which can be used according to the present invention are polyolefin waxes, ester waxes, polyolefin-polyether block copolymers, amide waxes, polyglycols, fatty acids, fatty alcohols, natural waxes and solid phosphoric acid derivatives. Preferred solid lubricants are thermomeltable particles such as those described in WO 94/11199. Liquid lubricants which can be used according to the present invention according to the present invention are fatty acid esters such as glycerine trioleate, sorbitan monooleate and sorbitan trioleate, silicone oil derivatives and phosphoric acid derivatives.

The protective layer of the recording material according to the present invention may comprise a matting agent. Suitable matting agents are described in WO 94/11198 and include e.g. talc particles and optionally protrude from the protective layer.

According to a preferred embodiment of the substantially light-insensitive black and white monosheet thermographic recording material of the present invention the thermosensitive element is provided with a protective layer containing a second polymer having active hydrogen atoms and a second polyisocyanate.

Antihalation Dyes

In addition to the ingredients, the thermographic recording materials used in the present invention may also contain antihalation or acutance dyes which absorb infra-red light, for absorption by a dye which converts the absorbed infra-red light into heat, which has passed through the thermosensitive element thereby preventing its reflection. Such dyes may be incorporated into the thermosensitive element or in any other layer of the recording material of the present invention.

Coating Techniques

The coating of any layer of the substantially light-insensitive black and white thermographic recording material used in the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, USA. Coating may proceed from aqueous or solvent media with overcoating of dried, partially dried or undried layers.

Thermographic Printing

Direct thermal imaging is carried out by the image-wise application of heat either in analogue fashion by direct exposure through an image of by reflection from an image, or in digital fashion pixel by pixel either by using an infra-red heat source, for example with a Nd-YAG laser or other infra-red laser, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. The electric pulses thus converted into thermal signals manifest themselves as heat transferred to the surface of the thermal paper wherein the chemical reaction resulting in colour development takes place. Such thermal printing heads may be used in contact or close proximity with the recording layer. The operating temperature of common thermal printheads is in the range of 300 to 400° C. and the heating time per picture element (pixel) may be less than 1.0 ms, the pressure contact of the thermal printhead with the recording material being e.g. 200–500g/cm$^2$ to ensure a good transfer of heat.

In order to avoid direct contact of the thermal printing heads with a recording layer not provided with an outermost protective layer, the image-wise heating of the recording layer with the thermal printing heads may proceed through a contacting but removable resin sheet or web wherefrom during the heating no transfer of recording material can take place.

The image signals for modulating the laser beam or current in the micro-resistors of a thermal printhead are obtained directly or from an intermediary storage means, optionally linked to a digital image work station wherein the image information can be processed to satisfy particular needs.

Activation of the heating elements can be power-modulated or pulse-length modulated at constant power. EP-A 654 355 describes a method for making an image by image-wise heating by means of a thermal head having energizable heating elements, wherein the activation of the heating elements is executed duty cycled pulsewise. When used in thermographic recording operating with thermal printheads the imaging materials are not suitable for reproducing images with fairly large number of grey levels as is required for continuous tone reproduction. EP-A 622 217 discloses a method for making an image using a direct thermal imaging element producing improvements in continuous tone reproduction. Image-wise heating of the thermographic material can also be carried out using an electrically resistive ribbon incorporated into the material. Image- or pattern-wise heating of the thermographic material may also proceed by means of pixel-wise modulated ultra-sound.

INDUSTRIAL APPLICATION

Thermographic imaging can be used for the production of transparencies and reflection type prints. Application of the present invention is envisaged in the field of graphics images requiring high contrast images with a very steep dependence of print density upon applied dot energy. In the hard copy field thermographic recording materials on a white opaque base are used, whereas black-imaged transparencies are widely used in inspection techniques operating with a light box.

The invention is illustrated hereinafter by way of invention examples and comparative examples. The percentages and ratios given in these examples are by weight unless otherwise indicated. The ingredients used in the invention and comparative examples, other than those mentioned above, are:

in the thermosensitive element:

organic silver salt:
AgBeh=silver behenate;

the binders:
BR 18=PIOLOFORM™ BR 18, a polyvinyl butyral from WACKER CHEMIE;
LL4160=PIOLOFORM™ LL4160, a polyvinyl butyral from WACKER CHEMIE;

reducing agent:
R01=ethyl 3,4-dihydroxybenzoate;

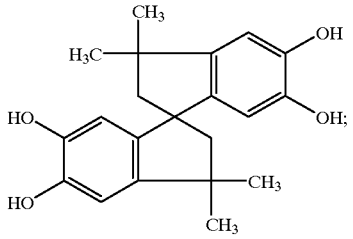

polyisocyanates:
N100=DESMODUR™ N100 from BAYER;

toning agents:
T01=benzo[e][1,3]oxazine-2,4-dione;
T02=7-(ethylcarbonato)-benzo[e][1,3]oxazine-2,4-dione;

silicone oil:
Oil=BAYSILON™ MA, a polydimethylsiloxane from BAYER;

stabilizers:

S01=tetrachlorophthalic anhydride;

S02=3'-decanoylamino-1-phenyl-1H-tetrazole-5-thiol

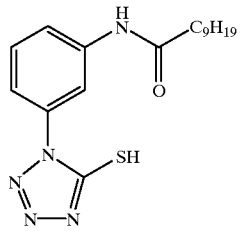

S03=

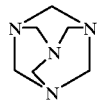

S04=

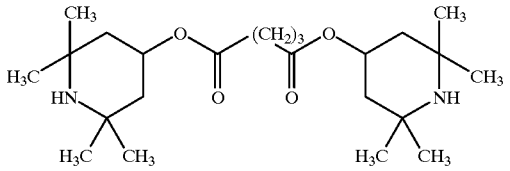

S05=2-[2'-hydroxy-3',5'-(di-t-butyl)phenyl)-5-chlorobenzotriazole, TINUVIN™ 327 from CIBA-GEIGY:

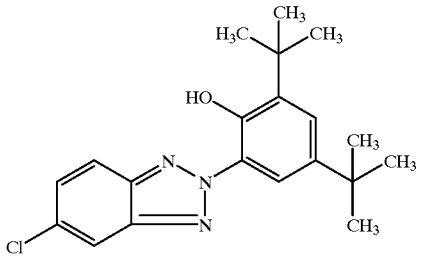

S06=

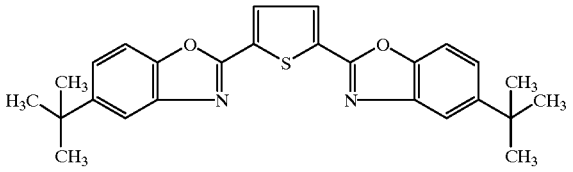

S07=zinc oxide.

and in the protective layer the following additional ingredients:

MICRODOL™ SUPER, a talc from Norwegian Talc AS;

TEGOGLIDE™ 410, a polysiloxane/polyether block copolymer from Goldschmidt;

SYLOID™ 72, a colloidal silica from GRACE.

INVENTION EXAMPLES 1 TO 6 AND COMPARATIVE EXAMPLE 1 TO 9

Preparation of the Thermosensitive Element

The subbed 120 μm thick polyethylene terephthalate support was doctor blade-coated with a composition containing 2-butanone as solvent/dispersing medium so as to obtain thereon, after hardening for 3 minutes at 85° C., a thermosensitive element with the compositions summarized in table 1 below:

| | | |
|---|---|---|
| AgBeh | = | 3.149 g/m$^2$ |
| BR 18 | = | 3.149 g/m$^2$ |
| R01 | = | 0.643 g/m$^2$ |
| T01 | = | 0.172 g/m$^2$ |
| Oil | = | 0.012 g/m$^2$ |
| S01 | = | 0.075 g/m$^2$ |
| S02 | = | 0.068 g/m$^2$ |
| N100 | = | 0.315 g/m$^2$ |

The thermosensitive element of the thermographic recording materials of COMPARATIVE EXAMPLE 1 to 9 and INVENTION EXAMPLES 1 to 6 was then overcoated with the following protective layer compositions and hardened for 3 minutes at 85° C.:

TABLE 1

| | stabilizer | | | MICRO- | | |
|---|---|---|---|---|---|---|
| | STAB nr. | mol % vs AgBeh | BR 18 [g/m$^2$] | DOL SUPER [g/m$^2$] | SYLOID 72 [g/m$^2$] | N100 [g/m$^2$] |
| Comparative example | | | | | | |
| 1 | — | — | 2.4 | 0.02 | 0.02 | 0.3 |
| 2 | S04 | 3 | 2.4 | 0.02 | 0.02 | 0.3 |
| 3 | S04 | 10 | 2.4 | 0.02 | 0.02 | 0.3 |
| 4 | S06 | 3 | 2.4 | 0.02 | 0.02 | 0.3 |
| 5 | S06 | 10 | 2.4 | 0.02 | 0.02 | 0.3 |
| 6 | S05 | 3 | 2.4 | 0.02 | 0.02 | 0.3 |
| 7 | S05 | 10 | 2.4 | 0.02 | 0.02 | 0.3 |
| 8 | S03 | 3 | 2.4 | 0.02 | 0.02 | 0.3 |
| 9 | S03 | 10 | 2.4 | 0.02 | 0.02 | 0.3 |
| Invention example | | | | | | |
| 1 | 13 | 10 | 2.4 | 0.02 | 0.02 | 0.3 |
| 2 | 07 | 3 | 2.4 | 0.02 | 0.02 | 0.3 |
| 3 | 03 | 3 | 2.4 | 0.02 | 0.02 | 0.3 |
| 4 | 03 | 10 | 2.4 | 0.02 | 0.02 | 0.3 |
| 5 | 05 | 10 | 2.4 | 0.02 | 0.02 | 0.3 |
| 6 | 08 | 3 | 2.4 | 0.02 | 0.02 | 0.3 |

Thermographic Printing

The printer was equipped with a thin film thermal head with a resolution of 300 dpi and was operated with a line time of 6.5ms (the line time being the time needed for printing one line). During this line time the print head received constant power. The average printing power, being the total amount of electrical input energy during one line time divided by the line time and by the surface area of the heat-generating resistors was 1.6 mJ/dot being sufficient to obtain maximum optical density in each of the thermographic recording materials of COMPARATIVE EXAMPLES 1 to 9 and INVENTION EXAMPLES 1 to 6.

The maximum and minimum densities of the prints given in table 2 were measured through a visible filter with a MACBETH™ TR924 densitometer in the grey scale step corresponding to data levels of 64 and 0 respectively and are given in table 2.

Sheld-Life Test

The shelf-life of the thermographic recording materials of COMPARATIVE EXAMPLES 1 to 9 and INVENTION EXAMPLES 1 to 6 was evaluated on the basis of the observed changes in maximum density, $\Delta D_{max}$, and the change in the CIELAB a* and b* values at the minimum density. The CIELAB-values were determined by spectrophotometric with evaluation according to AST M Norm E179-90 in a R(45/0) geometry with evaluation according to ASTM Norm E308-90. The results are summarized in table 2.

Light Stability Tests

The suntest was carried out on thermographic recording materials of COMPARATIVE EXAMPLES 1 to 9 and INVENTION EXAMPLES 1 to 6 using a SUNTEST CPS apparatus from HERAEUS. The thermographic recording materials were exposed through a glass filter with removes infrared light with wavelengths above 700 nm and ultraviolet light with wavelengths below 310 nm to a light flux from a low pressure xenon lamp NXE 1500 of approximately 110Lux under ambient conditions. The results are summarized in table 2.

This demonstrates the improved stability of the image background and in particular the image tone thereof to simulated exposure to direct sunlight of thermographic recording materials with non-chlorine-containing 2-(2'-hydroxyphenyl)benzotriazole derivatives (stabilizers STAB 03, 05, 07 and 08) and non-chlorine-containing 2-hydroxybenzophenone derivatives (stabilizer STAB 13) compared with thermographic recording materials without them.

COMPARATIVE EXAMPLE 10 to 14 & INVENTION EXAMPLE 7

The thermosensitive elements of the substantially light-insensitive black and white monosheet thermographic recording materials of COMPARATIVE EXAMPLES 10 to 14 and INVENTION EXAMPLE 7 were produced as described for INVENTION EXAMPLES 1 to 6 and COMPARTIVE EXAMPLES 1 to 9 except that the protective layers were as given in table 3 below and were hardened for 3 minutes at 90° C. instead of 3 minutes at 850° C.

TABLE 2

| | STAB | mol % vs | print after hardening at 85° C. for 3 min | | | after 240 h suntest | | Shelf-life after 3 d at 57° C./34% RH | | |
|---|---|---|---|---|---|---|---|---|---|---|
| | | | $D_{max}/D_{min}$ | at $D_{min}$ | | at $D_{min}$ | | $\Delta D_{min}$ | at $D_{min}$ | |
| | nr. | AgBeh | (vis) | a* | b* | a* | b* | (vis) | a* | b* |
| Comparative example number | | | | | | | | | | |
| 1 | — | — | 1.75/0.04 | −0.36 | 3.49 | −0.92 | 6.99 | 0.00 | −0.43 | 3.11 |
| 2 | S04 | 3 | 1.51/0.04 | −0.36 | 3.31 | −0.71 | 7.58 | 0.00 | −0.4 | 3.34 |
| 3 | S04 | 10 | 1.37/0.04 | −0.52 | 3.34 | 5.97 | 27 | +0.01 | −0.13 | 6.48 |
| 4 | S06 | 3 | 1.80/0.04 | −1.59 | 4.82 | 0.99 | 13.34 | 0.00 | −1.33 | 4.82 |
| 5 | S06 | 10 | 1.79/0.04 | −3.85 | 9.55 | 1.36 | 25.6 | 0.00 | −3.03 | 8.01 |
| 6 | S05 | 3 | 1.72/0.04 | −0.66 | 3.82 | 1.34 | 9.69 | 0.00 | −0.53 | 3.79 |
| 7 | S05 | 10 | 1.68/0.04 | −0.89 | 4.24 | 4.96 | 15.82 | 0.00 | −0.67 | 5.03 |
| 8 | S03 | 3 | 1.52/0.04 | −0.33 | 5.23 | −0.77 | 8.42 | 0.00 | −0.33 | 4.23 |
| 9 | S03 | 10 | 1.69/0.04 | 0.69 | 7.76 | −0.25 | 10.47 | +0.01 | 0.69 | 7.76 |
| Invention example nr | | | | | | | | | | |
| 1 | 13 | 10 | 1.71/0.04 | −0.42 | 3.41 | −0.55 | 6.44 | 0.00 | −0.19 | 9.81 |
| 2 | 07 | 3 | 1.72/0.04 | −0.41 | 3.7 | −0.81 | 5.48 | 0.00 | −0.54 | 9.77 |
| 3 | 03 | 3 | 1.71/0.04 | −0.22 | 3.46 | −0.11 | 6.52 | 0.00 | −0.29 | 4.11 |
| 4 | 03 | 10 | 1.72/0.04 | −0.59 | 4.01 | −0.39 | 5.95 | 0.00 | −0.25 | 4.35 |
| 5 | 05 | 10 | 1.81/0.04 | −0.78 | 4.3 | −0.36 | 5.89 | 0.00 | −0.18 | 3.32 |
| 6 | 08 | 3 | 1.84/0.04 | −0.59 | 3.68 | −0.51 | 6.6 | 0.00 | −0.38 | 3.65 |

There is clearly a lower increase in CIELAB-b* value of the image background of prints after the 240h suntest that with thermographic recording materials of INVENTION EXAMPLES 1 to 6 with the non-chlorine-containing stabilizers STAB 03, 05, 07, 08 and 13 than for the thermographic material of COMPARATIVE EXAMPLE 1 without a stabilizer i.e. the tone neutrality of the image has been better maintained during the suntest. The stability of the background image tone of thermographic recording materials of INVENTION EXAMPLS 1 and 2 with stabilizers STAB 13 and STAB 07 respectively was significantly worse than that for INVENTION EXAMPLES 3 to 6 with the non-chlorine-containing stabilizers STAB 03, STAB 05 and STAB 08 as can be seen by the change in CIELAB-a* and -b* values.

TABLE 3

| | stabilizer | | | MICRO- | | |
|---|---|---|---|---|---|---|
| | STAB nr. | mol % vs AgBeh | BR 18 [g/m²] | DOL SUPER [g/m²] | SYLOID 72 [g/m²] | N100 [g/m²] |
| Comparative example | | | | | | |
| 10 | S07 | 5 | 2.4 | 0.02 | 0.02 | 0.3 |
| 11 | S07 | 10 | 2.4 | 0.02 | 0.02 | 0.3 |
| 12 | S07 | 15 | 2.4 | 0.02 | 0.02 | 0.3 |
| 13 | S07 | 20 | 2.4 | 0.02 | 0.02 | 0.3 |
| 14 | S07 | 40 | 2.4 | 0.02 | 0.02 | 0.3 |

TABLE 3-continued

| | stabilizer | | | MICRO-DOL SUPER | SYLOID 72 | N100 |
|---|---|---|---|---|---|---|
| | STAB nr. | mol % vs AgBeh | BR 18 [g/m$^2$] | [g/m$^2$] | [g/m$^2$] | [g/m$^2$] |
| Invention example | | | | | | |
| 7 | 03 | 10 | 2.4 | 0.02 | 0.02 | 0.3 |

Thermographic evaluation of the substantially light-insensitive black and white monosheet thermographic recording materials of INVENTION EXAMPLE 7 and COMPARATIVE EXAMPLES 10 to 14 was carried out as described for INVENTION EXAMPLES 1 to 6 and COMPARATIVE EXAMPLES 1 to 9 except that the thermographic recording materials were also subjected to a 5 day BB test. In the BB test the thermographic recording materials were placed 1 meter directly below a 2000 W halogen lamp type THS 3007 from Siefried Theimer GmbH, 6484 Bernstein, Germany for 5 days under ambient conditions. This light-source produces UVA (320–380 nm), UVB (280–320 nm)and UVC (below 280 nm) light. All the results are given in table 4.

TABLE 4

| | stabilizer | | print after hardening at 85° C. for 3 min | | | after 5 days BB test at $D_{min}$ | | Shelf-life after 3 d at 57° C./34% RH | | |
|---|---|---|---|---|---|---|---|---|---|---|
| | STAB nr. | mol % vs AgBeh | $D_{max}/D_{min}$ (vis) | at $D_{min}$ a* | at $D_{min}$ b* | a* | b* | $\Delta D_{min}$ (vis) | at $D_{min}$ a* | at $D_{min}$ b* |
| Comparative example number | | | | | | | | | | |
| 12 | S07 | 5 | 1.66/0.04 | −0.19 | 3.83 | 18.50 | 84.85 | 0.00 | −0.08 | 3.89 |
| 13 | S07 | 10 | 1.48/0.04 | −0.12 | 3.14 | 15.83 | 79.41 | 0.00 | 0.03 | 4.4 |
| 14 | S07 | 15 | 1.62/0.04 | −0.06 | 3.24 | 17.16 | 77.69 | −0.01 | −0.07 | 4.42 |
| 15 | S07 | 20 | 1.64/0.04 | −0.1 | 3.3 | 12.66 | 79.12 | 0.00 | −0.04 | 4.75 |
| 16 | S07 | 40 | 1.65/0.04 | −0.12 | 3.42 | 10.19 | 73.83 | −0.01 | −0.11 | 4.87 |
| Invention example number | | | | | | | | | | |
| 12 | 03 | 10 | 1.57/0.04 | −0.2 | 3.56 | 3.52 | 65.19 | 0.00 | −0.1 | 4.39 |

It is clear from the results of the thermographic evaluation of the thermographic recording materials of COMPARATIVE EXAMPLES 10 to 14 and INVENTION EXAMPLE 12, the use of zinc oxide as a UV-absorber in the protective layer results in a prohibitive yellowing of the image as to be seen by the much higher CIELAB-a* values of the image background of prints with the thermographic recording materials of COMPARATIVE EXAMPLES 10 to 14 compared with that of the thermographic recording material of INVENTION EXAMPLE 7 and poorer stability of the background image tone in the 5 day BB test, particular as regards the CIELAB-a* value.

Therefore incorporation into the thermographic recording materials of zinc oxide, a known inorganic UV-stabilizer, does not produce stability to direct sunlight.

COMPARATIVE EXAMPLE 15 & INVENTION EXAMPLES 8 to 16

The thermosensitive elements of the substantially light-insensitive black and white monosheet thermographic recording materials of INVENTION EXAMPLES 8 to 16 & COMPARATIVE EXAMPLE 15 were produced as described for INVENTION EXAMPLES 1 to 6 and COMPARATIVE EXAMPLES 1 to 9 except that T02 was used instead of T01 and 0.102 g/m$^2$ of R02 was added to the thermosensitive element and the protective layers were as given in table 5 below.

TABLE 5

| | stabilizer | | BR 18 | N100 |
|---|---|---|---|---|
| | STAB nr. | mol % vs AgBeh | [g/m$^2$] | [g/m$^2$] |
| Comparative example | | | | |
| 15 | — | — | 1.8 | 0.23 |
| Invention example | | | | |
| 8 | 07 | 1 | 1.8 | 0.23 |
| 9 | 07 | 2 | 1.8 | 0.23 |
| 10 | 07 | 3 | 1.8 | 0.23 |

TABLE 5-continued

| | stabilizer | | BR 18 | N100 |
|---|---|---|---|---|
| | STAB nr. | mol % vs AgBeh | [g/m$^2$] | [g/m$^2$] |
| 11 | 03 | 3 | 1.8 | 0.23 |
| 12 | 03 | 10 | 1.8 | 0.23 |
| 13 | 03 | 13 | 1.8 | 0.23 |
| 14 | 05 | 10 | 1.8 | 0.23 |
| 15 | 05 | 13 | 1.8 | 0.23 |
| 16 | 13 | 10 | 1.8 | 0.23 |

Thermogrphic evaluation of the substantially light-insensitive black and white monosheet thermographic recording materials of INVENTION EXAMPLES 8 to 16 and COMPARATIVE EXAMPLE 15 was carried out as described for INVENTION EXAMPLES 1 to 6 and COMPARATIVE EXAMPLES 1 to 9. The results are summarized in table 6.

The thermographic results of the thermographic recording materials of COMPARATIVE EXAMPLE 15 and INVENTION EXAMPLES 8 to 16 confirm the results obtained with the thermographic recording materials of INVENTION EXAMPLES 1 to 6, that there is a lower increase in CIELAB-b* value of the image background of prints after the 240 h suntest with thermographic recording materials containing the stabilizers STAB 03, 05, 07 and 13 than that for the thermographic material of COMPARATIVE EXAMPLE 15 without a stabilizer i.e. the tone neutrality of the image has been better maintained during the suntest.

TABLE 6

| | stabilizer | | print after hardening | | | after 240 h | | Shelf-life after 3 d | | |
|---|---|---|---|---|---|---|---|---|---|---|
| | | mol % | at 85° C. for 3 min | | | suntest | | at 57° C./34% RH | | |
| | STAB | vs | $D_{max}/D_{min}$ | at $D_{min}$ | | at $D_{min}$ | | $\Delta D_{min}$ | at $D_{min}$ | |
| | nr. | AgBeh | (vis) | a* | b* | a* | b* | (vis) | a* | b* |
| Comparative example number | | | | | | | | | | |
| 15 | — | — | 1.89/0.04 | −0.06 | 3.03 | 0.03 | 14.93 | 0.00 | −0.04 | 3.57 |
| Invention example number | | | | | | | | | | |
| 8 | 07 | 1 | 1.94/0.04 | −0.31 | 3.27 | 0.01 | 14.35 | 0.00 | 0.07 | 3.25 |
| 9 | 07 | 2 | 20.3/0.04 | −0.25 | 3.29 | 0.56 | 12.31 | 0.00 | −0.33 | 3.61 |
| 10 | 07 | 3 | 2.06/0.04 | −0.35 | 3.52 | 0.8 | 11.55 | 0.00 | −0.35 | 3.71 |
| 11 | 03 | 3 | 1.79/0.04 | −0.18 | 3.17 | 0.55 | 13.18 | 0.00 | −0.27 | 3.24 |
| 12 | 03 | 10 | 2.03/0.04 | −0.45 | 3.57 | 0.8 | 10.08 | 0.00 | −0.22 | 4.16 |
| 13 | 03 | 13 | 2.07/0.04 | −0.34 | 3.88 | 1.2 | 8.8 | 0.00 | −0.49 | 3.19 |
| 14 | 05 | 10 | 1.97/0.04 | −0.43 | 3.56 | 0.32 | 12.81 | 0.00 | −0.32 | 4.03 |
| 15 | 05 | 13 | 1.96/0.04 | −0.39 | 3.59 | 0.25 | 12.5 | 0.00 | −0.42 | 3.52 |
| 16 | 13 | 10 | 2.05/0.04 | −0.2 | 3.35 | 0.23 | 14.55 | 0.00 | −0.22 | 3.85 |

This demonstrates the improved stability of the image background and in particular the image tone thereof to simulated exposure to direct sunlight of thermographic recording materials with the non-chlorine-containing 2-(2'-hydroxyphenyl)benzotriazole derivatives stabilizers STAB 03, 05 and 07) and non-chlorine-containing 2-hydroxybenzophenone derivatives (stabilizer STAB 13) compared with thermographic recording materials without them.

INVENTION EXAMPLE 17

Stabilizer in Both Thermosensitive Element and Protective Layer

The thermosensitive elements of the substantially light-insensitive black and white monosheet thermographic recording materials of INVENTION EXAMPLE 17 was produced as described for INVENTION EXAMPLES 1 to 6 and COMPARATIVE EXAMPLES 1 to 9 except that the thermosensitive element composition was as follows:

| | | |
|---|---|---|
| AgBeh | = | 3.89 g/m$^2$ |
| BR 18 | = | 3.89 g/m$^2$ |
| STAB 03 | = | 0.15 g/m$^2$ |
| R01 | = | 0.855 g/m$^2$ |
| T02 | = | 0.219 g/m$^2$ |
| Oil | = | 0.144 g/m$^2$ |
| S01 | = | 0.094 g/m$^2$ |
| S02 | = | 0.085 g/m$^2$ |
| N100 | = | 0.401 g/m$^2$ |

The thermosensitive element of the thermographic recording materials of INVENTION EXAMPLES 17 was then overcoated with the following protective layer composition and hardened for 3 minutes at 85° C.:

| | | |
|---|---|---|
| BR 18 | = | 1.844 g/m$^2$ |
| MICRODOL ™ SUPER | = | 0.184 g/m$^2$ |
| STAB 03 | = | 0.228 g/m$^2$ |
| Oil | = | 0.012 g/m$^2$ |
| N100 | = | 0.183 g/m$^2$ |

Thermographic evaluation of the substantially light-insensitive black and white monosheet thermographic recording materials of INVENTION EXAMPLES 17 was carried out as described for INVENTION EXAMPLES 1 to 6 and COMPARATIVE EXAMPLES 1 to 9. The results are summarized in table 7.

TABLE 7

| Invention example number | stabilizer in thermosensitive element & protective layer STAB number. | print after hardening at 85° C. for 3 min $D_{max}/D_{min}$ (vis) | at $D_{min}$ a* | b* | after 5 days BB test at $D_{min}$ a* | b* | Shelf-life after 3 d at 57° C./34% RH $\Delta D_{min}$ (vis) | at $D_{min}$ a* | b* |
|---|---|---|---|---|---|---|---|---|---|
| 17 | 03 | 2.29/0.04 | −0.3 | 3.15 | 2.07 | 50.82 | +0.02 | −0.35 | 4.47 |

With a stabilizer as used in the present invention in both the thermosensitive element and the protective layer of the thermographic recording material of INVENTION EXAMPLE 17 according to the present invention, the increase in CIELAB b* value after 5 days exposure to a 2000 W halogen lamp was less marked than in the case of the same stabilizer, STAB 03, only in the protective layer (see INVENTION EXAMPLE 12).

INVENTION EXAMPLES 18 to 26

The thermosensitive elements of the substantially light-insensitive black and white monosheet thermographic recording materials of INVENTION EXAMPLE 18 to 26 were produced as described for INVENTION EXAMPLES 1 to 6 and COMPARATIVE EXAMPLES 1 to 9 except that the thermosensitive element compositions were as given in table 8 and the materials were hardened at 85° C. for 15 minutes without overcoating with a protective layer.

TABLE 8

| Invention example nr | Stabilizer STAB nr | mol % vs AgBeh | AgBeh g/m² | LL4160 g/m² | R01 g/m² | T02 g/m² | Oil g/m² | S01 g/m² | S02 g/m² | N100 g/m² |
|---|---|---|---|---|---|---|---|---|---|---|
| 18 | 03 | 5.28 | 3.379 | 3.379 | 0.738 | 0.189 | 0.128 | 0.203 | 0.073 | 0.348 |
| 19 | 04 | 5 | 3.379 | 3.379 | 0.738 | 0.189 | 0.128 | 0.203 | 0.073 | 0.348 |
| 20 | 04 | 15 | 3.379 | 3.379 | 0.738 | 0.189 | 0.128 | 0.203 | 0.073 | 0.348 |
| 21 | 11 | 5 | 3.379 | 3.379 | 0.738 | 0.189 | 0.128 | 0.203 | 0.073 | 0.348 |
| 22 | 11 | 7.06 | 3.379 | 3.379 | 0.738 | 0.189 | 0.128 | 0.203 | 0.073 | 0.348 |
| 23 | 11 | 9.88 | 3.379 | 3.379 | 0.738 | 0.189 | 0.128 | 0.203 | 0.073 | 0.348 |
| 24 | 07 | 0.7 | 3.379 | 3.379 | 0.738 | 0.189 | 0.128 | 0.203 | 0.073 | 0.348 |
| 25 | 07 | 0.84 | 3.379 | 3.379 | 0.738 | 0.189 | 0.128 | 0.203 | 0.073 | 0.348 |
| 26 | 07 | 0.98 | 3.379 | 3.379 | 0.738 | 0.189 | 0.128 | 0.203 | 0.073 | 0.348 |

Thermographic printing was carried out as described for INVENTION EXAMPLES 1 to 6 and COMPARATIVE EXAMPLES 1 to 9 except that the printhead was separated from the imaging layer by a thin intermediate material contacted with a slipping layer of a separable 5 μm thick polyethylene terephthalate ribbon coated successively with a subbing layer, heat-resistant layer and the slipping layer (anti-friction layer) giving a ribbon with a total thickness of 6 μm.

The shelflife tests were carried out as described for INVENTION EXAMPLES 1 to 6 and COMPARATIVE EXAMPLES 1 to 9 and the image evaluation carried out as described for INVENTION EXAMPLES 1 to 6 and COMPARATIVE EXAMPLES 1 The results are summarized in table 9.

Light Test

The stability of the image background of prints produced using thermographic recording materials of INVENTION EXAMPLES 18 to 26 to post-image development exposure was evaluated by exposing fresh prints for 3 days on top of the white PVC window of a specially constructed light-box placed in a VOTSCH™ conditioning cupboard set at 30° C. and a relative humidity of 85%. Only a central area of the window 550 mm long by 500 mm wide was used for mounting the test materials to ensure uniform exposure.

The stainless steel light-box used was 650 mm long, 600 mm wide and 120 mm high with an opening 610 mm long and 560 mm wide with a rim 10 mm wide and 5 mm deep round the opening, thereby forming a platform for a 5 mm thick plate of white PVC 630 mm long and 580 mm wide, making the white PVC-plate flush with the top of the light-box and preventing light loss from the light-box other than through the white PVC-plate. This light-box was fitted with 9 PLANILUX™ TLD 36 W/54 fluorescent lamps 27 mm in diameter mounted length-wise equidistantly from the two sides, with the lamps positioned equidistantly to one another and the sides over the whole width of the light-box and with the tops of the fluorescent tubes 30 mm below the bottom of the white PVC plate and 35 mm below the materials being tested.

The suitability of a material was assessed on the basis of the L*, a* and b* CIELAB-values of the background determined by spectrophotometric measurements according to ASTM Norm E179-90 in a R(45/0) geometry with evaluation according to ASTM Norm E308-90. The results are described in table 9.

TABLE 9

| Invention example number | stabilizer in thermo-sensitive element STAB number. | mol % vs AgBeh | fresh print after hardening at 85° C. for 3 min $D_{max}/D_{min}$ (vis) | at $D_{min}$ a* | b* | Light box after 3 d at 30° C./85% RH at $D_{min}$ a* | b* | Shelf-life after 3 d at 57° C./34% RH $\Delta D_{min}$ (vis) |
|---|---|---|---|---|---|---|---|---|
| 18 | 03 | 5.28 | 2.88/0.06 | −0.41 | 2.2 | −0.86 | 4.93 | 0.00 |
| 19 | 04 | 5 | 3.29/0.06 | −0.35 | 2.3 | −0.95 | 5.05 | 0.00 |
| 20 | 04 | 15 | 3.31/0.06 | −0.57 | 2.76 | −0.91 | 5.38 | 0.00 |
| 21 | 11 | 5 | 2.88/0.06 | −0.44 | 2.31 | −0.69 | 4.31 | 0.00 |
| 22 | 11 | 7.06 | 2.78/0.06 | −0.55 | 2.04 | −1.01 | 4.53 | 0.00 |
| 23 | 11 | 9.88 | 2.84/0.06 | −0.44 | 2.19 | −1.04 | 4.91 | 0.00 |
| 24 | 07 | 0.7 | 2.91/0.06 | −0.41 | 2.2 | −0.98 | 4.74 | 0.00 |
| 25 | 07 | 0.84 | 2.89/0.06 | −0.36 | 1.97 | −0.88 | 4.55 | 0.00 |
| 26 | 07 | 0.98 | 2.89/0.06 | −0.34 | 2.05 | −0.98 | 4.14 | 0.00 |

The lightbox a* and b* measurements show an excellent image tone stability for the background, indicated by the low increases in a* and b*-values over the a* and b*-values of the fresh prints. This is particularly the case for the thermographic recording materials of INVENTION EXAMPLES 21, 22, 25 and 26.

INVENTION EXAMPLES 27 to 34

Stabilizer in Both Thermosensitive Element and Protective Layer

The thermosensitive elements of the substantially light-insensitive black and white monosheet thermographic recording materials of INVENTION EXAMPLE 27 to 34 correspond to the thermosensitive elements of the substantially light-insensitive black and white monosheet thermographic recording materials of INVENTION EXAMPLE 19 to 26 respectively. The thermosensitive element of the thermographic recording materials of INVENTION EXAMPLES 27 to 34 were then overcoated with the protective layer compositions given in table 10 and finally hardened for 3 minutes at 85° C.

TABLE 10

| Invention example nr | thermosensitive element = thermo-sensitive element of Invention example number | Stabilizer in protective layer STAB nr | mol % vs AgBeh in thermo-sensitive element | LL4160 g/m² | MICRODOL ™ SUPER g/m² | Oil g/m² | TEGOGLIDE ™ 410 g/m² | N100 g/m² |
|---|---|---|---|---|---|---|---|---|
| 27 | 19 | 04 | 5 | 1.539 | 0.092 | 0.006 | 0.02 | 0.154 |
| 28 | 20 | 04 | 15 | 1.539 | 0.092 | 0.006 | 0.02 | 0.154 |
| 29 | 21 | 07 | 5 | 1.539 | 0.092 | 0.006 | 0.02 | 0.154 |
| 30 | 22 | 07 | 7.06 | 1.539 | 0.092 | 0.006 | 0.02 | 0.154 |
| 31 | 23 | 07 | 9.88 | 1.539 | 0.092 | 0.006 | 0.02 | 0.154 |
| 32 | 24 | 07 | 0.7 | 1.539 | 0.092 | 0.006 | 0.02 | 0.154 |
| 33 | 25 | 07 | 0.84 | 1.539 | 0.092 | 0.006 | 0.02 | 0.154 |
| 34 | 26 | 07 | 0.98 | 1.539 | 0.092 | 0.006 | 0.02 | 0.154 |

Thermographic evaluation of the substantially light-insensitive balck and white monosheet thermographic recording materials of INVENTION EXAMPLES 27 to 34 was carried out as described for INVENTION EXAMPLES 18 to 26. The results are summarized in table 11.

TABLE 11

| Invention example number | thermosensitive element ≡ thermo-sensitive element of Invention example number | stabilizer in protective layer STAB nr | mol % vs AgBeh | print after hardening at 85° C. for 3 min $D_{max}/D_{min}$ (vis) | at $D_{min}$ a* | b* | Light box after 3 d at 30° C./85% RH at $D_{min}$ a* | b* | Shelf-life after 3 d at 57° C./34% RH $\Delta D_{min}$ (vis) |
|---|---|---|---|---|---|---|---|---|---|
| 27 | 19 | 04 | 32.5 | 2.32/0.06 | −0.64 | 3.01 | −1.05 | 5.09 | 0.00 |
| 28 | 20 | 04 | 20 | 1.78/0.06 | −0.67 | 3.01 | −0.82 | 4.95 | 0.00 |
| 29 | 21 | 07 | 2.1 | 2.09/0.06 | | | −0.38 | 3.91 | 0.00 |
| 30 | 22 | 07 | 2.1 | 2.32/0.06 | | | −0.47 | 4.12 | 0.00 |
| 31 | 23 | 07 | 2.1 | 2.12/0.06 | | | −0.56 | 4.07 | +0.02 |
| 32 | 24 | 07 | 2.1 | 2.42/0.06 | | | −0.6 | 4.22 | +0.01 |
| 33 | 25 | 07 | 2.1 | 2.25/0.06 | | | −0.53 | 3.86 | +0.01 |
| 34 | 26 | 07 | 2.1 | 2.28/0.06 | | | −0.49 | 3.44 | 0.00 |

The lightbox a* and b* measurements for the thermographic recording materials of INVENTION EXAMPLES 29 to 34 show even lower a* and b*-values than for the thermographic recording materials of INVENTION EXAMPLES 21 to 26 with thermosensitive elements with identical compositions indicating that the provision of a protective layer with 2.1 mol% STAB 07 brings about an addition stabilization in the image background. This is particularly marked in the cases of thermographic recording materials of INVENTION EXAMPLES 30, 31, 32, 33 and 34 for which b* values of 3.91, 4.12, 4,07, 3.86 and 3.44 were measured.

Having described in detail preferred embodiments of the current invention, it will now be apparent to those skilled in the art that numerous modifications can be made therein without departing from the scope of the invention as defined in the following claims.

What is claimed is:

1. A substantially light-insensitive black and white non-chlorine-containing stabilizer-containing monosheet thermographic recording material comprising a support and a thermosensitive element, said thermosensitive element containing a substantially light-insensitive organic silver salt, a reducing agent therefor in thermal working relationship therewith and a binder, wherein said non-chlorine-containiing stabilizer is selected from the group consisting of 2-(2'-hydroxyphenyl) benzotriazole derivatives and 2-hydroxy-benzophenone derivatives, wherein said non-chlorine-containing 2-(2'-hydroxyphenyl) benzotriazole derivative contains a 2-hydroxy-benzophenone group.

2. A substantially light-insensitive black and white non-chlorine-containing stabilizer-containing monosheet thermographic recording material comprising a support and a thermosensitive element, said thermosensitive element containing a substantially light-insensitive organic silver salt, a reducing agent therefor in thermal working relationship therewith and a binder, wherein said non-chlorine-containing stabilizer is selected from the group consisting of 2-(2'-hydroxyphenyl) benzotriazole derivatives and 2-hydroxy-benzophenone derivatives, wherein said reducing agent is a 1,2-dihydroxybenzene derivative.

3. The thermographic recording material according to claim 2, wherein said non-chlorine-containing 3-(2'-hydroxyphenyl)benzotriazole derivative is selected from the group consisting of 2-[2'-hydroxy-3', 5'-(di-t-butyl)phenyl]-benzotriazole, 2-[2'hydroxy-3',5'-di-(α, α-dimethylbenzyl) phenlyl]-benzotriazole, 2,2-methylene-bis-[5-(2H-benzotriazol-1-yl)-3-(1",1",3",3"-tetramethylbutyl)-phenol],

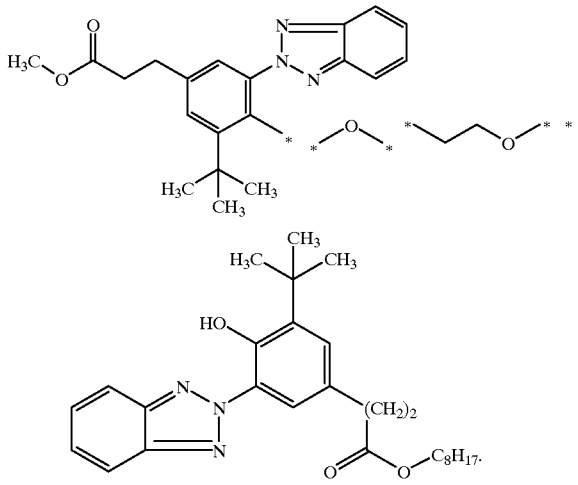

4. The thermographic recording material according to claim 2, wherein said substantially light-insensitive organic silver salt is a silver salt of an aliphatic carboxylic acid having at least 12 carbon atoms.

5. A substantially light-insensitive black and white non-chlorine-containing stabilizer-containing monosheet thermographic recording material comprising a support and a thermosensitive element, said thermosensitive element containing a substantially light-insensitive organic silver salt, a reducing agent therefor in thermal working relationship therewith and a binder, wherein said non-chlorine-containing stabilizer is selected from the group consisting of 2-(2'-hydroxyphenyl) benzotriazole derivatives and 2-hydroxy-benzophenone derivatives, wherein said binder is a first polymer having active hydrogen atoms at least part of which has reacted with a first polyisocyanate.

6. A substantially light-insensitive black and white non-chlorine-containing stabilizer-containing monosheet thermographic recording material comprising a support and a thermosensitive element, said thermosensitive element containing a substantially light-insensitive organic silver salt, a reducing agent therefor in thermal working relationship therewith and a binder, wherein said non-chlorine-containing stabilizer is selected from the group consisting of 2-(2'-hydroxyphenyl) benzotriazole derivatives and 2-hydroxy-benzophenone derivatives, wherein said thermosensitive element is further provided with a protective layer.

7. A substantially light-insensitive black and white non-chlorine-containing stabilizer-containing monosheet thermographic recording material comprising a support and a thermosensitive element, said thermosensitive element containing a substantially light-insensitive organic silver salt, a reducing agent therefor in thermal working relationship therewith and a binder, wherein said non-chlorine-containing stabilizer is selected from the group consisting of 2-(2'-hydroxyphenyl) benzotriazole derivatives and 2-hydroxy-benzophenone derivatives, wherein said thermosensitive element is further provided with a protective layer, wherein said protective layer contains a second polymer having active hydrogen atoms at least part of which has reacted with a second polyisocyanate.

8. A recording process comprising (i) bringing an outermost layer of a substantially light-insensistive black and white non-chlorine-containing stabilizer-containing monosheet thermographic recording material comprising a support and a thermosensitive element into proximity with a heat source, said thermosensitive element containing a substantially light-insensitive organic silver salt, a reducing agent therefor in thermal working relationship therewith and a binder;

(ii) applying heat from said heat source imagewise to said thermographic recording material while maintaining proximity to said heat source to produce an image; and (iii) removing said thermographic recording material from said heat source, wherein said reducing agent is a 1,2-dihydroxybenzene derivative and said non-chlorine-containing stabilizer is selected from the group consisting of 2-(2'-hydroxyphenyl) benzotriazole derivatives and 2-hydroxy-benzophenone derivatives.

9. The recording process according to claim 8, wherein said non-chlorine-containing 2-(2'-hydroxyphenyl) benzotriazole derivative contains a 2-hydroxy-benzophenone group.

10. The recording process according to claim 8, wherein said binder is a first polymer having active hydrogen atoms at least part of which has reacted with a first polyisocyanate.

11. The recording process according to claim 8, wherein said thermosensitive element is further provided with a protective layer.

12. The recording process according to claim 8, wherein said thermosensitive element is further provided with a protective layer, wherein said protective layer contains a second polymer having active hydrogen atoms at least part of which has reacted with a second polyisocyanate.

13. A recording process comprising (i) brining an outermost layer of a substantially light-insensitive black and white non-chlorine-containing monosheet thermographic recording material comprising a support and a thermosensitive element into proximity with a heat source, wherein said heat source is a thin thermal head, said thermosensitive element containing a substantially light-insensitive organic silver salt, a reducing agent therefor in thermal working relationship therewith and a binder;

(ii) applying heat from said heat source imagewise to said thermographic recording material while maintaining proximity to said heat source to produce an image; and (iii) removing said thermographic recording material from said heat source, wherein said non-chlorine-containing stabilizer is selected from the group consisting of (2'-hydroxyphenyl) benzotriazole derivatives and 2-hydroxy-benzophenone derivatives, wherein said non-chlorine-containing 2-(2'-hydroxylphenyl) benzotriazole derivative contains a 2-hydroxy-benzophenone group.

14. A process for the use of a non-chlorine-containing stabilizer selected from the group consisting of 2-(2'-hydroxyphenyl)-benzotriazole derivatives and 2-hydroxy-benzophenone derivatives as a stabilizer against direct sunlight in a substantially light-insensitive black and white monosheet thermographic recording material comprising a support and a thermosensitive element, the thermosensitive element containing a substantially light-insensitive organic silver salt, a 1,2-dihydroxybenzene derivative as reducing agent therefor in substantial working relationship therewith and a binder comprising (i) bringing an outermost layer of a substantially light-insensitive black and white non-chlorine containing stabilizer-containing monosheet thermographic recording material comprising a support and a thermosensitive element into proximity with a heat source, said thermosensitive element containing a substantially light-insensitive organic silver salt, a reducing agent therefor in thermal working relationship therewith and a binder;

(ii) applying heat from said heat source imagewise to said thermographic recording material while maintaining proximity to said heat source to produce an image; and (iii) removing said thermographic recording material from said heat source.

15. The process according to claim 14, wherein said non-chlorine-containing 2-(2'-hydroxyphenyl) benzotriazole derivative contains a 2-hydroxy-benzophenone group.

16. The process according to claim 14, wherein said binder is a first polymer having active hydrogen atoms at least part of which has reacted with a first polyisocyanate.

17. The process according to claim 14, wherein said thermosensitive element is further provided with a protective layer.

18. The process according to claim 14, wherein said thermosensitive element is further provided with a protective layer, wherein said protective layer contains a second polymer having active hydrogen atoms at least part of which has reacted with a second polyisocyanate.

* * * * *